United States Patent [19]

Balck

[11] Patent Number: 4,850,331

[45] Date of Patent: Jul. 25, 1989

[54] SAW FOR CUTTING THIN DISKS

[75] Inventor: Juergen Balck, Horneburg, Fed. Rep. of Germany

[73] Assignee: Ernst Winter & Sohn (GmbH & Co.), Hamburg, Fed. Rep. of Germany

[21] Appl. No.: 120,416

[22] Filed: Nov. 13, 1987

[30] Foreign Application Priority Data

Nov. 20, 1986 [DE] Fed. Rep. of Germany ..... 3639700

[51] Int. Cl.[4] ..... B28D 1/04

[52] U.S. Cl. ..... 125/15; 51/206 R; 51/209 R

[58] Field of Search ..... 125/15; 51/206 R

[56] References Cited

U.S. PATENT DOCUMENTS 3,626,921 12/1971 Lane ..... 125/15

FOREIGN PATENT DOCUMENTS 669364 12/1938 Fed. Rep. of Germany ..... 125/15

*Primary Examiner*—Frederick R. Schmidt
*Assistant Examiner*—Maurina Rachuba
*Attorney, Agent, or Firm*—Michael J. Striker

[57] ABSTRACT

A saw for cutting thin disks from a bar includes a thin blade provided with an inner hole and having in the peripheral region of that hole a diamond coating which has a different thickness on two opposing external sides of the blade to avoid bending of the blade due to a non-uniform loading of the blade. The coating is thicker on the non-stable side of the blade, which faces the disk being cut off.

3 Claims, 1 Drawing Sheet

B1
B2
B1 =2,0mm
B2=2,5mm
X2=90 µm
270µm
X1 =60 µm
X1
X2
1
2
3
4
5
6
7
8
9

SAW FOR CUTTING THIN DISKS

BACKGROUND OF THE INVENTION

The present invention relates to a saw having an inner hole and adapted particularly for cutting thin disks from bars.

Saws of the type under discussion normally include a thin blade provided in the center line thereof with an inner hole. This blade carries in the edge region of the inner hole a coating made of diamond or boron nitride grains which are held in a galvanic bonding. The coating covers the internal cylindrical face of the inner hole and the edge portion of the blade at two external sides thereof.

Such saws make use, for example, in the electronic industry for cutting "wafers" which are extremely thin disks cut from the bar of monocrystalline silicon. A particular utilization of such saws can be found for making chips.

The saw having an inner hole is usually formed of a laminated sheet or blade which has the thickness of, for example 0.12 mm or 120 μm. This sheet or blade has an inner hole the edge of which at all sides is covered with a diamond coating galvanically applied thereto. The coating normally covers the inner edge of the hole so as to form a bead at the end of the blade. In addition to this coating on the inner cylindrical surface of the hole the blade also has at two sides thereof, namely at two edge regions closing the hole a diamond coating of about 2 mm in length.

When such saws with an inner hole are used the thin sheet or blade is clamped in a clamping ring to provide high rigidity. The clamping ring is positioned in the saw machine and is rotated when in operation. Thereby the distance between the inner edge of the inner hole of the saw blade and the clamping ring permits the cutting of the bar of the corresponding diameter. The use of such a saw is particularly advantageous when it is necessary to cut articles of very expensive materials such as monocrystalline silicon because the actual width of the cut and assumed losses should be small.

The problem with these otherwise satisfactory saws provided with inner holes is however that during the cutting process the disk being cut could bend towards the saw blade. To reduce such a bending the saw blade during the cutting process has been positioned with its stable side to face the bar and with its non-stable side to face the disk being separated from the bar. It should be noted in this connection that due to relatively large forces on the stable side no elastic or plastic deformations occur. Relatively small forces on the non-stable side of the blade can, however, cause, particularly in dependence upon the thickness of the disk being cut off the bar elastic and also plastic deformations lead in unfavorable cases, to a strong bending of the disk being cut off towards the saw blade or even to the contact with the saw blade. Due to the occurring friction such a bending can cause a destruction of the disk due to the deformations in the disk and losses of its stability. To avoid such a disadvantage it has been proposed to provide a thicker diamond coating at both sides of the saw blade. If the bead-shaped diamond coating at both sides of the saw blade were substantially reinforced this would result in a considerably greater width of the cut which is disadvantageous taking into consideration the fact that this would lead to losses of an expensive material.

SUMMARY OF THE INVENTION

It is an object of the present invention to provide an improved saw of the foregoing type.

It is another object of the invention to provide a saw formed with an inner hole, which would substantially reduce waste in producing disks cut off the bar and would provide a small width of cut during the cutting process.

These and other objects of the invention are attained by a saw for cutting thin disks from a monocrystalline silicon bar, comprising a thin blade formed in a middle thereof with an inner hole, said blade having at said hole an edge region which carries thereon a coating, said coating being formed of at least diamond and boron nitride grains bound in a galvanic bonding, said coating covering an inner cylindrical surface of said inner hole and an edge portion of the blade, limiting said hole, at two external sides of said blade, a thickness of said coating on a side of the blade which faces away from a disk to be cut being at least partially greater than a thickness of said coating on another side of the blade. Thus, the thickness of the diamond coating or layer on the non-stable side is greater than that on the so-called stable side of the saw blade. The advantage of such a structure resides in that the distance between the blade of the saw and the side of the disk which faces the saw will be greater than before so that the danger of contact of the bending disk being cut with the blade would be substantially reduced if not prevented and, on the other hand, the effective width of the cut would not be significantly increased.

Also, it should be taken into consideration that with two diamond material layers of different thickness on the edge of the blade, a deflection of the blade during its clamping can take place. If the saw blade is during operation strongly clamped the inner hole will stretch or expand. Due to such expansion the coating in the edge region of the hole would cause a lateral deflection, particularly in case of different thickness of the coating on two external sides. This would cause different counter forces at two sides of the blade during the clamping of the blade and a force compensation by tilting of the stronger side to the weaker side, which would result in an enlarged width of the cut.

Therefore in addition to the coatings of different thickness at two external sides of the blade, it is provided in the saw of this invention that the entire surface or amount of the coating on each side of the blade is the same.

This can be obtained by that the coating may have a widened end portion which is thicker on said side of the blade, which faces said disk, than on said another side.

The coating on said another side of the blade may be longer than on said side which faces said disk, provided that the coating on said another side is thinner than on the opposite side.

Also the coatings on both sides of the blade can be of the same length while the coating on the non-stable side can be thinner than on the stable side; however, in this case a beadshaped end portion of the coating would be much thicker on the non-stable side of the blade as compared to the stable side thereof.

The chief advantage of the saw blade according to the invention resides in that with the maintaining of a conventional width of the cut the function of the saw is improved and material losses of the disks being separated from the bar are reduced due to a lateral redistribution of the coating on the blade surfaces.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figures 1, 2, 3:
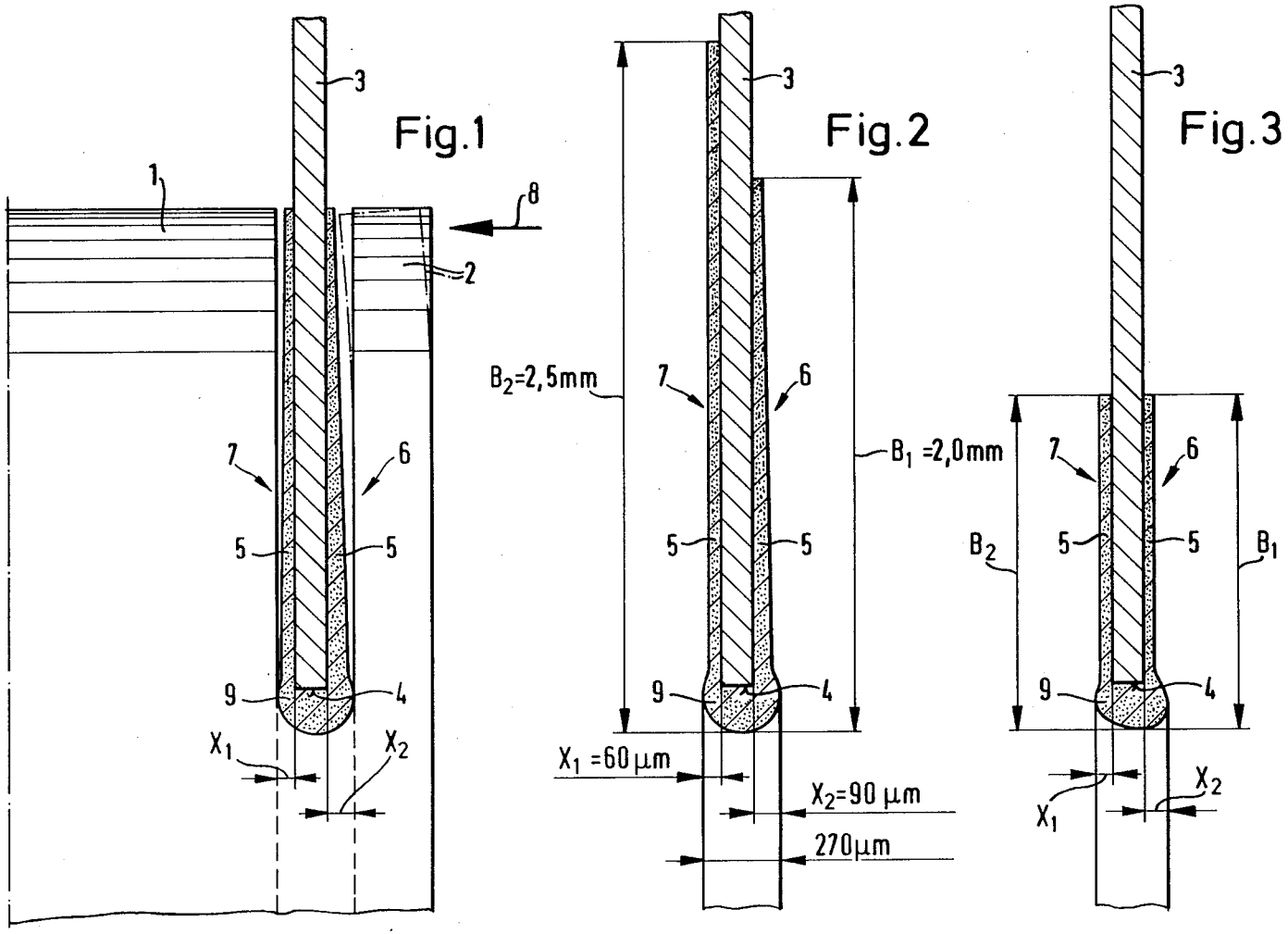
FIG. 1 is a schematic view of the saw according to the invention in operative condition.
FIG. 2 is a schematic view of the peripheral portion of the saw, on enlarged scale.
FIG. 3 is a partial schematic view of the saw of the modified embodiment of the invention.

Referring now to the drawings in detail, FIG. 1 shows a bar 1 of monocrystalline silicon. Extremely thin disks 2 should be cut off the bar 1. A saw according to this invention is designed to separate disks 2 from bar 1. The saw is formed of a thin metal blade 3 which in the middle thereof is provided with an inner hole 4. Blade 3 which can be made of chromium nickel steel has the thickness of 0.12 mm.

The peripheral area of the inner hole 4 is surrounded with a diamond coating 5. Individual diamond grains are held in a metallic binder. The diamond coating 5 encircles the cylindrical inner rim of the inner hole 4 and the edge portion at both sides of the blade 3. To separate disk 2 from the bar 1 the latter is driven into the inner hole 4 of the blade 3. Finally the disk 2 is separated from bar 1 by blade 3 and its inner hole 4. As understood there is a danger of bending of the disk 2 being cut in the direction of arrow 8 and thereby its contact with the blade 3 upon advancing the cut depth. In order to avoid such a situation the diamond coating at the side 6 of blade 3 which is a so-called non-stable side is thicker or stronger as on the opposite side 7 which is considered as a stable side. Thereby the danger of contact of disk 2 with blade 3 is reduced.

The greater extension of the diamond layer from the face of the blade 3 is indicated in FIG. 1 at $X_2$ while the diamond layer of a smaller thickness is denoted at $X_1$.

The ratio between the diamond coating thicknesses in the peripheral or edge region at the inner hole of blade 3 of the saw is shown in FIG. 2 on a greatly enlarged scale. In this embodiment the diamond coating 5 at the edge region on the non-stable side 6 has the length $L_1=2.0$ mm and on the stable side 7 $L_2=2.5$ mm. The thickness of the diamond coating on the non-stable side 6 in the end area $X_2=90$ $\mu$m, and the diamond coating thickness on the stable side 7 in that region $X_1=60$ $\mu$m. The total coating thickness in the end area amounts to 270 $\mu$m.

Length $L_1$ of the coating on the non-stable area 6 is smaller than length $L_2$ of the coating on the opposite side 7. At the same time, the coating 5 on the non-stable side is thicker than that on the stable side of the blade so that altogether approximately the same amount of the diamond grains in the binder are found at each side of the blade 3.

In the embodiment of FIG. 3 the diamond coating at the end or head of the blade is thicker on the non-stable side 6 while on the stable side 7 at that end it is thinner. The length of the diamond coatings at both sides of the blade are the same. In order to obtain a material compensation and thereby tension compensation the coating 5 on the non-stable side 6 is thinner than that on the stable side 7.

It is, of course, understood that the saw of this invention can be used for other polycrystalline materials or any other suitable materials than silicon or monocrystalline silicon, for example germanium.

It will be understood that each of the elements described above, or two or more together, may also find a useful application in other types of saws for cutting thin disks differing from the types described above.

While the invention has been illustrated and described as embodied in a saw for cutting thin disks, it is not intended to be limited to the details shown, since various modifications and structural changes may be made without departing in any way from the spirit of the present invention.

Without further analysis, the foregoing will so fully reveal the gist of the present invention that others can, by applying curent knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A saw for cutting thin disks from a monocrystalline silicon bar, comprising a thin blade having an axis and an inner edge which limits a central inner hole and has an inner cylindrical surface; and a coating applied on said edge of said blade, said coating including abrasive grains bound in a bonding, said coating having a head portion formed so that in the region of said inner cylindrical surface of said edge said head portion of said coating is wider than immediately adjacent side portions of said coating located at opposite axial sides of said blade, said head portion of said coating on one of said axial sides of said blade which faces disk to be cut having a thickness which is greater than a thickness of said head portion of said coating on an opposite one of said axial sides of said blade.

2. A saw as defined in claim 1, wherein said coating at said sides of said blade have different thicknesses and identical volumes.

3. A saw as defined in claim 1, wherein said coating includes abrasive grains selected from the group consisting of diamond grains and boron nitride grains, said bonding being a galvanic bonding.

* * * * *